US007174582B1

(12) United States Patent
Leary

(10) Patent No.: US 7,174,582 B1
(45) Date of Patent: Feb. 13, 2007

(54) CRIB MATTRESS BOUNCER

(76) Inventor: Kevin J Leary, 209 Bay Rd., Hamilton, MA (US) 01982

( * ) Notice: Subject to any disclaimer, the term of this patent is extended or adjusted under 35 U.S.C. 154(b) by 30 days.

(21) Appl. No.: 11/161,794

(22) Filed: Aug. 17, 2005

(51) Int. Cl.
*A47D 9/02* (2006.01)

(52) U.S. Cl. ..... 5/108; 5/107

(58) Field of Classification Search ..... 5/105–109; 297/260.1, 260.3; 601/98, 100
See application file for complete search history.

(56) References Cited

U.S. PATENT DOCUMENTS

| | | | | |
|---|---|---|---|---|
| 111,989 | A | 2/1871 | Stowell | |
| 171,388 | A | 12/1875 | Kirchner | |
| 238,704 | A * | 3/1881 | Menuez | 5/102 |
| 238,933 | A * | 3/1881 | Lenz | 5/108 |
| 374,277 | A | 12/1887 | Smith | |
| 417,812 | A | 12/1889 | Cobleigh | |
| 865,829 | A * | 9/1907 | Unger | 5/101 |
| 910,888 | A | 6/1909 | Wilson et al. | |
| 1,218,837 | A | 3/1917 | Christopher | |
| 1,227,710 | A | 5/1917 | Walsh | |
| 1,261,400 | A * | 4/1918 | Johnson | 5/104 |
| 1,386,236 | A | 8/1921 | Chambers | |
| 1,526,802 | A * | 2/1925 | Matthews | 5/106 |
| 2,543,043 | A | 2/1951 | Miltello | 155/108 |
| 2,765,478 | A | 10/1956 | Pinto | 5/104 |
| 2,810,428 | A | 10/1957 | Plese | 155/56 |
| 3,022,520 | A * | 2/1962 | Finger | 5/109 |
| 3,040,342 | A | 6/1962 | Broers | 5/109 |
| 3,159,851 | A | 12/1964 | Broers | 5/109 |
| 3,225,365 | A | 12/1965 | Miller et al. | 5/109 |
| 3,311,935 | A | 4/1967 | Petty | 5/109 |
| 3,529,311 | A * | 9/1970 | Crawford | 5/109 |
| 3,874,011 | A | 4/1975 | Walsh et al. | 5/108 |
| 3,885,787 | A | 5/1975 | Walker | 272/1 |
| 6,571,408 | B1 | 6/2003 | Wang | 5/99.1 |
| 6,884,226 | B2 * | 4/2005 | Pereira | 601/54 |

* cited by examiner

*Primary Examiner*—Michael Trettel
(74) *Attorney, Agent, or Firm*—George A. Herbster

(57) ABSTRACT

A crib mattress bouncing device includes a lever having a pivot structure for releasably engaging a mattress support frame at a first end of the lever. A clamping structure intermediate the ends of the lever structure engages a tensioned wire or like structure in a mattress support. Displacing the second end of the lever in a first direction deflects the attached and surrounding portions of the mattress support and mattress in a first direction. Releasing a force on the second end allows the mattress support to return to its original position. Repeated actuation of the second end of the lever structure produces a gentle bouncing motion of the mattress.

19 Claims, 7 Drawing Sheets

CRIB MATTRESS BOUNCER

FIELD OF THE INVENTION

This invention generally relates to children's beds, particularly cribs, and more particularly to an accessory for inducing a bouncing motion in a mattress for such beds that is soothing to a child.

DESCRIPTION OF RELATED ART

It is long known that a gentle rocking or bouncing can benefit a child's demeanor. Oftentimes this rocking or bouncing occurs in the arms or hands of an adult. Over the years, however, there have been a wide variety of proposals for simulating such rocking or bouncing motions in a cradle or crib by mechanical means.

For example, a certain group of proposals suggest that mechanical and electro-mechanical apparatus can provide a resilient support for an entire crib or cradle. U.S. Pat. No. 2,765,478 (1956) to Pinto discloses one such crib rocking device. A crib stands on coiled springs under each crib leg. A mechanically-driven crank attaches to the crib frame. When a motor is energized, a link from a crank oscillates the crib thereby producing a rocking motion of the entire crib.

A second group of proposals, that is a variation of the first group, suggests the addition of an accessory that attaches to part of the crib or rocker structure. For example, U.S. Pat. No. 2,543,043 (1951) to Millitello discloses a rocking device for cribs. In this case the structure of a crib is modified to accept a crank, springs and related structures. These structures provide an independently and resiliently supported mattress frame that can be rocked independently of the crib frame.

Still another group of devices incorporate the addition of treadles to rock a cradle or bassinet. For example, in U.S. Pat. No. 1,526,802 (1925) to Matthews a bassinet cradle includes a centrally pivoted lever that can be actuated by the foot to rock a bassinet.

Another group of devices includes electro-mechanical devices that induce vibrations or motions through cranks. U.S. Pat. No. 3,311,935 (1967) to Petty discloses a bed vibrating device. A vibrator attaches directly to a tensioned wire in an array of tensioned wires carried by a peripheral frame. Induced vibrations pass to the child through a mattress on the array. U.S. Pat. No. 3,529,311 (1970) to Crawford discloses an electro-mechanically driven crank that engages a central portion of a mattress support. This structure bounces the mattress by pulling the spring and mattress downwardly and then allowing it to return by spring tension to its initial position.

U.S. Pat. No. 3,885,787 (1975) to Walker is an example of another group of devices in which a mattress support is suspended by a central cam-like member mounted on a rod extending between the headboard and footboard of the crib. The degree of rotation of the cam-like device is controlled by a child's rotating a handle attached to one of the headboard or footboard. This deflects the bottom of spring device upward and controls the degree of motion of the platform as it tips from one side to another.

As will be apparent, these proposals have several inherent disadvantages. Adding accessory apparatus to move the entire structure or a portion of the structure can add significant cost. Such accessories tend to be customized for a particular crib design and therefore not readily adapted to a wide variety of cribs. Some of these accessories may elevate the crib tending to reduce accessibility to a parent and instability in the crib. U.S. Pat. Nos. 2,765,478 and 2,543,043 are examples of apparatus that are characterized by this disadvantage. Moreover, these two references require permanent modifications to an existing crib frame. The requirement for such modifications increases the complexity of installing such a device. U.S. Pat. Nos. 3,313,935 and 3,529,311 also are characterized by this disadvantage. Each of the foregoing references therefore can add significant expense for such a device thereby making the addition of such device less desirable.

Further, each of these devices disclose designs that are not readily transportable from one type of crib to another without significant installation, removal or other steps. U.S. Pat. Nos. 2,765,478, 2,543,043, 3,529,311 and 3,885,787 depict designs that have this disadvantage.

What is needed is a crib mattress bouncer that is inexpensive, that is easy to install and use, that can be used with a variety of crib frames and that can be manually operated either by grabbing the device with a hand or pushing the device with a foot.

SUMMARY

Therefore it is an object of this invention to provide a crib mattress bouncing device that induces a gentle motion in a crib mattress.

Another object of this invention is to provide a crib mattress bouncing device that induces a gentle motion in a crib mattress, that is easy to install and that requires no permanent modifications of the crib.

Still another object of this invention is to provide a crib mattress bouncing device that induces a gentle motion in a crib mattress, that is easy to use and that is ergonomically friendly for use by hand or foot.

Yet another object of this invention is to provide a crib mattress bouncing device that induces a gentle motion in a crib mattress, that is portable and that is useful in a variety of crib frame designs.

Still yet another object of this invention is to provide a crib mattress bouncing device that induces a gentle motion in a crib mattress and that is inexpensive.

In accordance with one aspect of this invention, a crib mattress bouncer induces a bouncing motion on a mattress support in a crib. The mattress support includes a peripheral frame and a flexible support spanning the peripheral frame. The crib mattress bouncer includes a lever with first and second ends, a pivot structure and a clamp. The pivot structure attaches to the first lever end for engaging the peripheral frame to enable the lever to pivot about the peripheral frame in a substantially vertical plane. The clamp is positioned at an intermediate position of the lever for engaging the flexible support. The lever forms an actuator adjacent its second end. Moving the actuator in one direction in the vertical plane causes the lever and the clamp to pivot about the frame and moves a portion of the flexible support. Releasing the actuator causes the lever and clamp to pivot about the peripheral frame in the opposite direction. Repeated use of the actuator thereby causes the mattress to bounce.

In accordance with another aspect of this invention, a crib mattress bouncer induces a bouncing motion on a mattress support in a crib. The mattress support includes a peripheral frame and an array of interconnected tension wires for supporting the mattress. The crib mattress bouncer includes a second-degree lever for releasably engaging the peripheral frame thereby to form a pivot at the peripheral frame that enables the lever to pivot in a substantially vertical plane. A clamp attaches to the lever structure intermediate the ends thereof for engaging at least one of the tension wires. The lever includes an actuator formed at the other end of the lever for enabling displacement of the lever in a vertical plane in a first direction to move the engaged and surrounding tension wires. Releasing the actuator causes the lever and clamp means to pivot about the frame in the opposite direction whereby repeated use of the actuator causes the mattress to bounce.

In accordance with yet another aspect of this invention, a crib comprises a crib frame including a headboard, footboard and side railings. The crib frame carries a mattress support that includes a peripheral frame, and a flexible support that spans a peripheral frame. The mattress support carries a mattress. A crib mattress bouncer induces motion of the mattress and includes a lever having first and second ends. A pivot structure includes an inverted channel attached to the first end of the lever. The inverted channel detachably engages the peripheral frame whereby the lever can pivot in a substantially vertical plane. A clamp attaches to the lever intermediate the ends thereof for engaging the flexible support at a central portion thereof. The second end of the lever forms an actuator. Vertical motion imparted to the actuator in one direction causes the lever and the clamp to pivot about the peripheral frame to move the central portion of the flexible support. Releasing the actuator causes the lever and clamp to pivot about the frame in the opposite direction. Repeated use of the actuator thereby causes the mattress to bounce.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
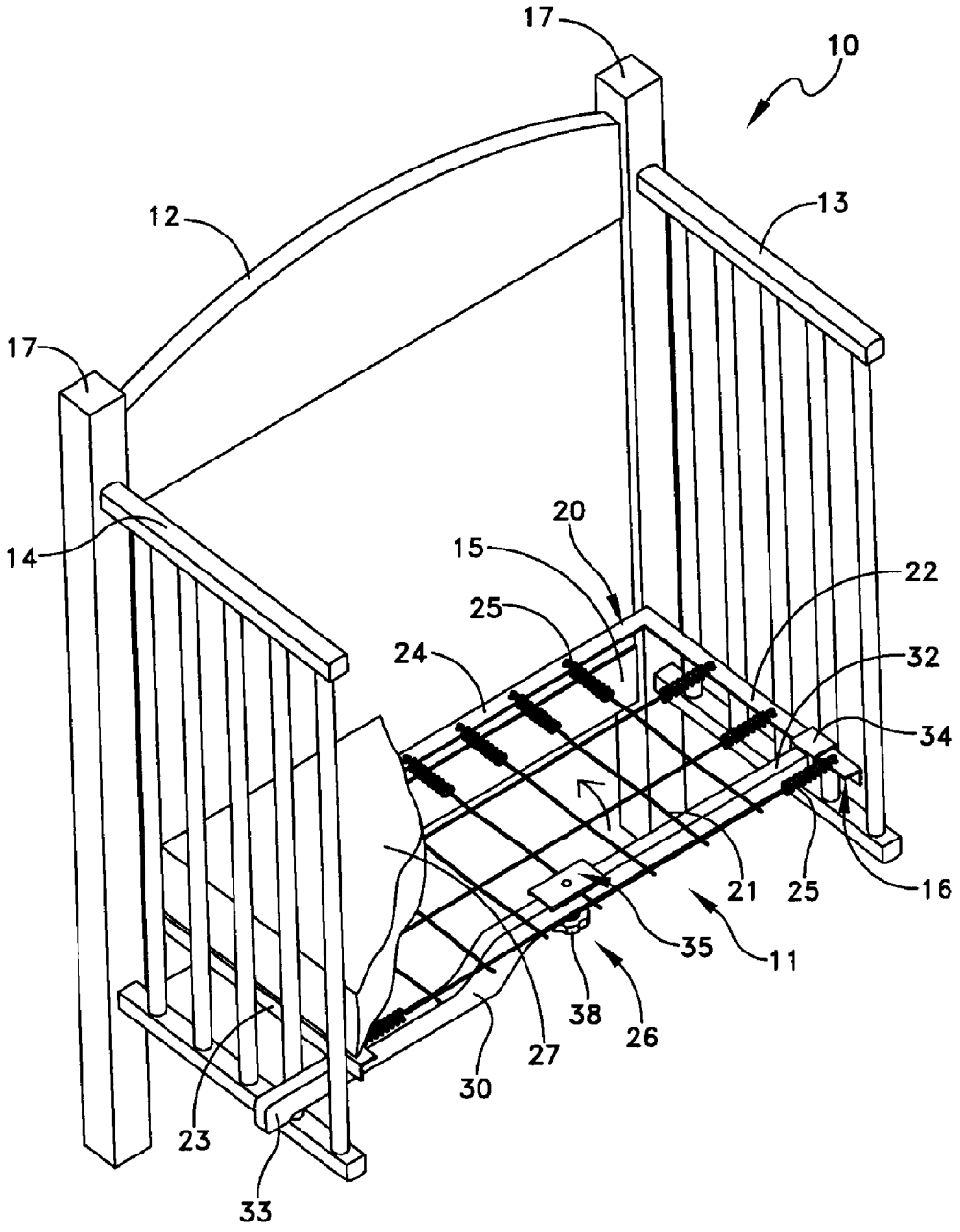
FIG. 1 depicts a portion of a crib including one embodiment of a crib bouncing mechanism for operation by hand constructed in accordance with this invention.

FIG. 1 depicts a conventional crib 10 and one embodiment of a crib mattress bouncer 11. The crib 10 may be any of a number of structures. FIG. 1 depicts a specific crib in which the crib frame includes a headboard 12, fixed side railings 13 and 14, a support rail 15 shown on the headboard 12 and a mattress support 16. In this embodiment, corner posts 17 serve as legs. In other embodiments one or both of the side rail 13 and 14 could be replaced by a vertically displaceable side railing. The mattress support 16 includes a peripheral frame 20. In this embodiment the support rail 15 on the headboard 12 and a corresponding support rail on a footbed (not shown) carry the peripheral frame 20. The peripheral frame 20 carries a plurality of tensioned wires 21 in an interconnected array. More specifically, the peripheral frame 20 includes side members 22 and 23 and a transverse end member 24. Springs 25 attach oppositely to each of the side frame members 22 and 23 and to the end members including the end frame member 24 to hold each of the wires 21 in tension. The wires form an array 26 that defines a flexible support that spans the peripheral frame 20 and that supports a mattress, a portion 27 of which is shown in FIG. 1.

Figure 2:
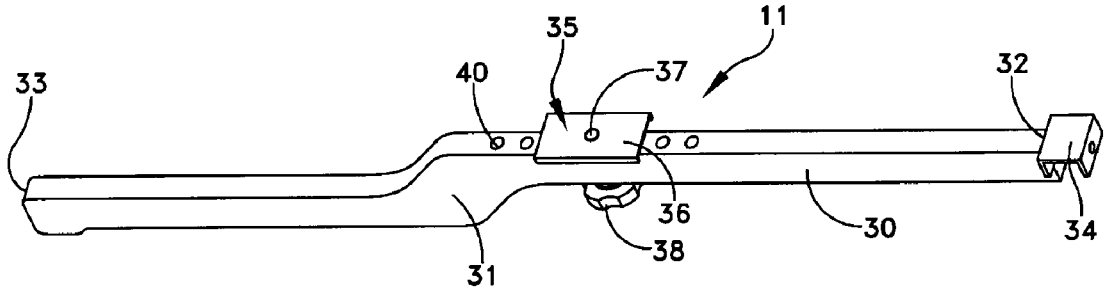
FIG. 2 is a perspective view of the crib bouncing device shown in FIG. 1.
Figure 3:
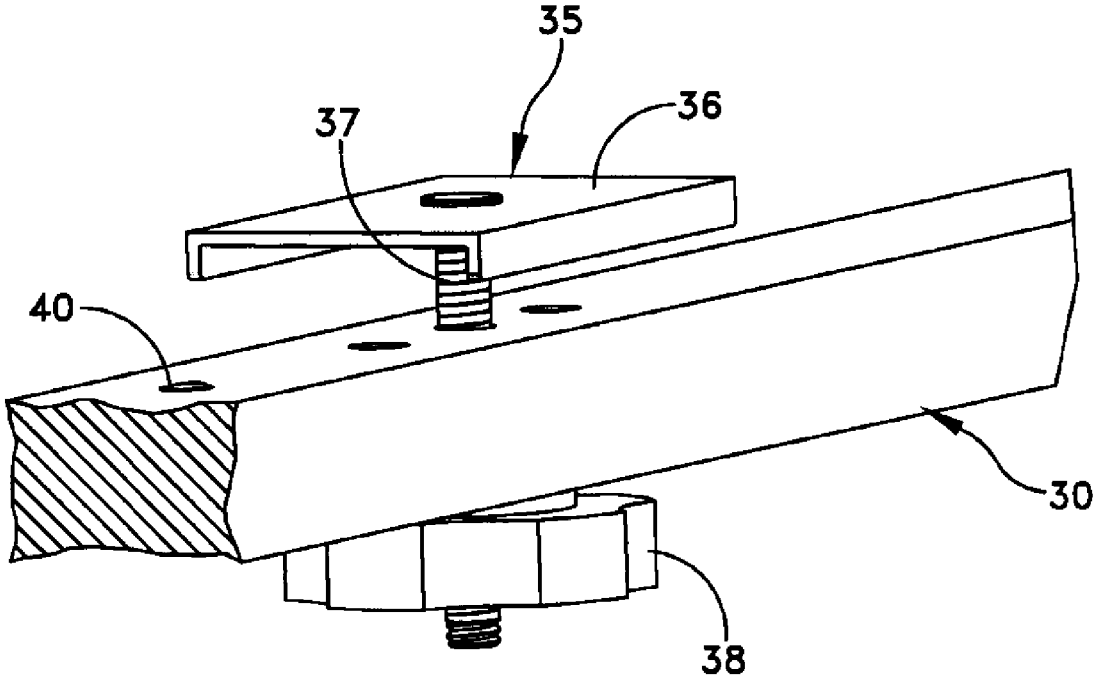
FIG. 3 is a detail of a clamping structure for the crib bouncing device shown in FIGS. 1 and 2.

The embodiment of the crib mattress bouncer 11 shown in FIGS. 1 and 2 includes a lever 30 having a mid portion 31, a first end 32 and a second end 33. An inverted channel bracket 34 attaches to the first end 32. Its opening faces down so, as shown in FIG. 1, the channel bracket 34 hooks onto the frame side member 22. Thus the bracket 34 is easily brought into engagement with and detached from the peripheral frame 20. This forms one embodiment of a pivot at the first end 32 that enables the lever 30 to move in a substantially vertical plane.

In this particular embodiment the second end 33 of the lever 30 constitutes a hand grip. The hand grip allows an individual outside the crib 10 to move the lever 30 from its normal position, either upwardly or downwardly, depending upon clearance between the frame 23 and horizontal portions of the side railing, such as the side railing 14 shown in FIG. 1.

A clamp structure 35 lies intermediate the first and second ends 32 and 33. In this specific embodiment the clamp structure 35 includes a clamping plate 36 and a machine screw 37 that could be attached to a thumb nut 38 disposed on the opposite side of the lever 30. In such an embodiment the lever additionally includes a plurality of attachment points 40. When the thumb nut 38 loosens the plate 36, it can be slid over one of the tensioned wires 21 in the array 26, preferably proximate the center of the array 26. Then the thumb nut 38 can be rotated to tighten the clamp structure 35 thereby to capture the corresponding wire as a portion of a flexible support between the clamp structure 35, particularly the clamp plate 36, and an adjacent surface of the lever 30.

Installation of the crib mattress bouncer 11 shown in FIG. 2 is a simple process. The mattress 27 is removed. The thumb nut 38 is loosened so the clamping plate 36 with its machine screw 37 can be removed from the lever 30. Then the lever 30 can be fed between stiles in the side railings, such as the stiles in the side railing 14 in FIG. 1, or beneath the side railing depending upon the construction of a specific crib frame. The inverted channel bracket 34 drops onto the side frame member, such as the side frame member 22. Then the lever 30 is elevated and the clamping plate 36 and machine screw 37 inserted through an appropriate one of the attachment points 40 in order that a portion of the clamping plate 36 overlies one of the tensioned wires 21. The thumb nut 38 tightens to capture the unit. The mattress 27 then is placed on the mattress support 16.

A parent has the option of either lifting or depressing the second end 33 of the lever 30. As this occurs, the mattress 27 is either lifted or depressed by virtue of the displacement of the attached tensioned wire and adjacent wires given the interconnected nature of the spring array 26. When the second end 33 has been displaced through its allowable range of motion, releasing or reducing the force on the second end 33 allows the tensioned wires to return to a normal position thereby reversing the motion of the mattress. Imparting this motion iteratively produces a gentle bouncing action of the mattress 27 with the magnitude and speed controlled by the individual operating the lever 30.

Figure 4:
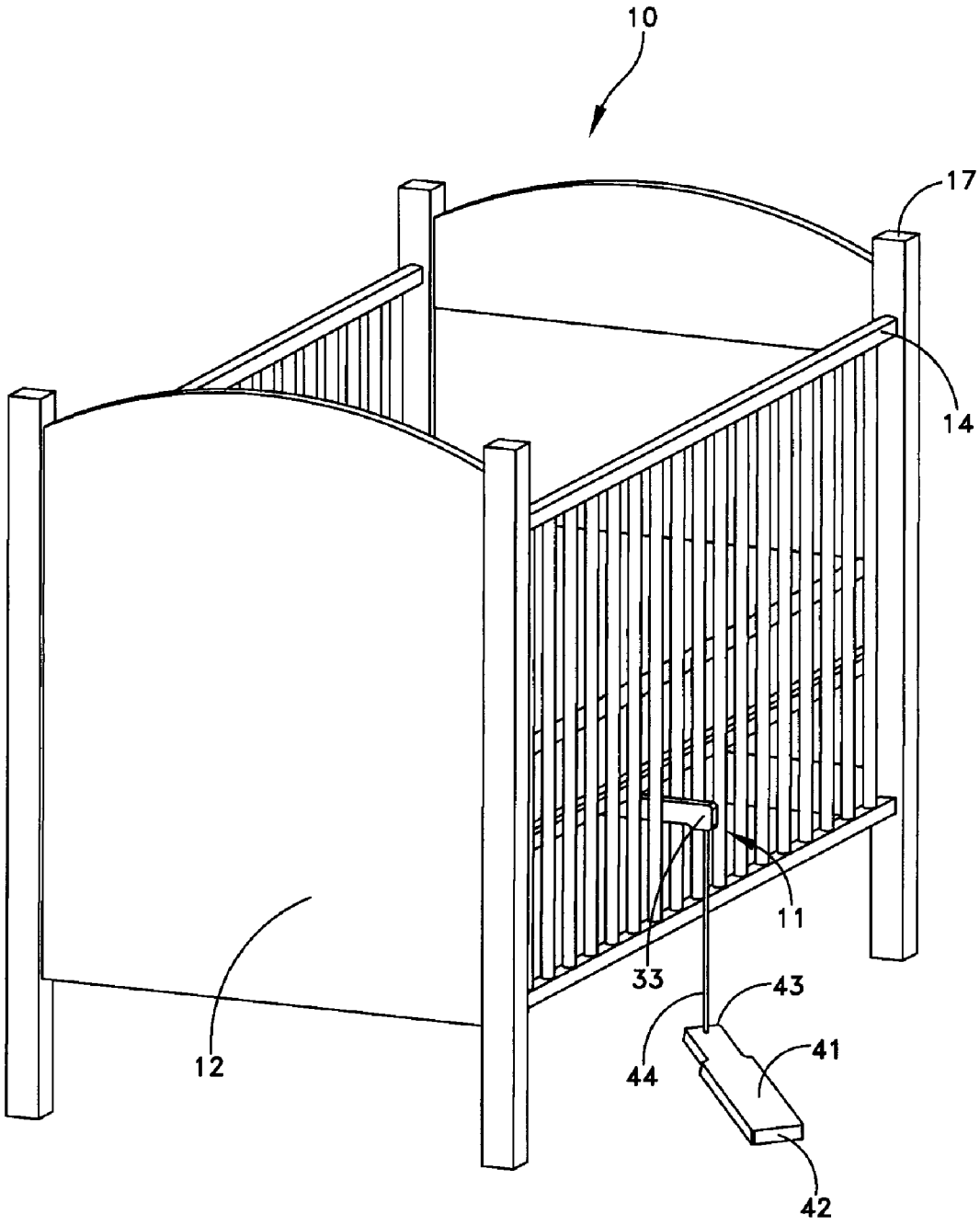
FIG. 4 depicts another embodiment of this invention whereby the crib bouncing device of FIGS. 1 and 2 is modified for foot operation.

FIG. 4 depicts another view of the crib 10 with its headboard 12, legs 17 and a side railing 14 through which the second end 33 of the lever extends. In this particular embodiment, the crib mattress bouncer of FIG. 2 if modified for foot operation by adding a treadle 41 having a pivot end 42 and a second end 43 connected to the second lever end 33 exteriorly of the crib frame by a link 44. The nature of the attachment between the link 44 and the second end 33 is not shown but will be apparent to those of ordinary skill in the art. This modification allows an individual to apply a downward force on the second end 33 by means of foot pressure on the treadle 41, with release of that pressure allowing the second end 33 to displace upward thereby to return to a normal position.

Figure 5:
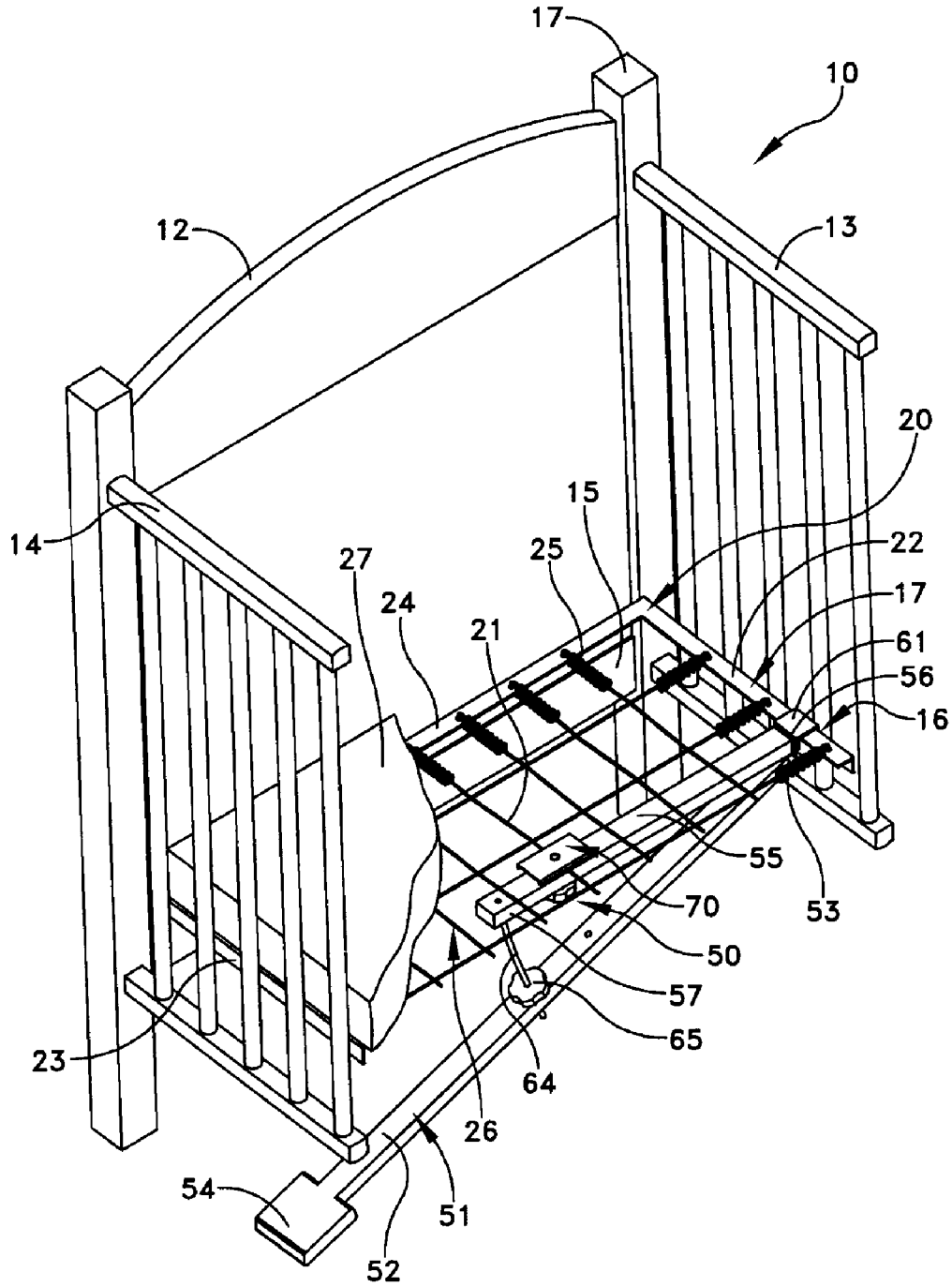
FIG. 5 depicts a portion of a crib in perspective with another embodiment of a crib bouncing device adapted for foot operation.
Figure 6:
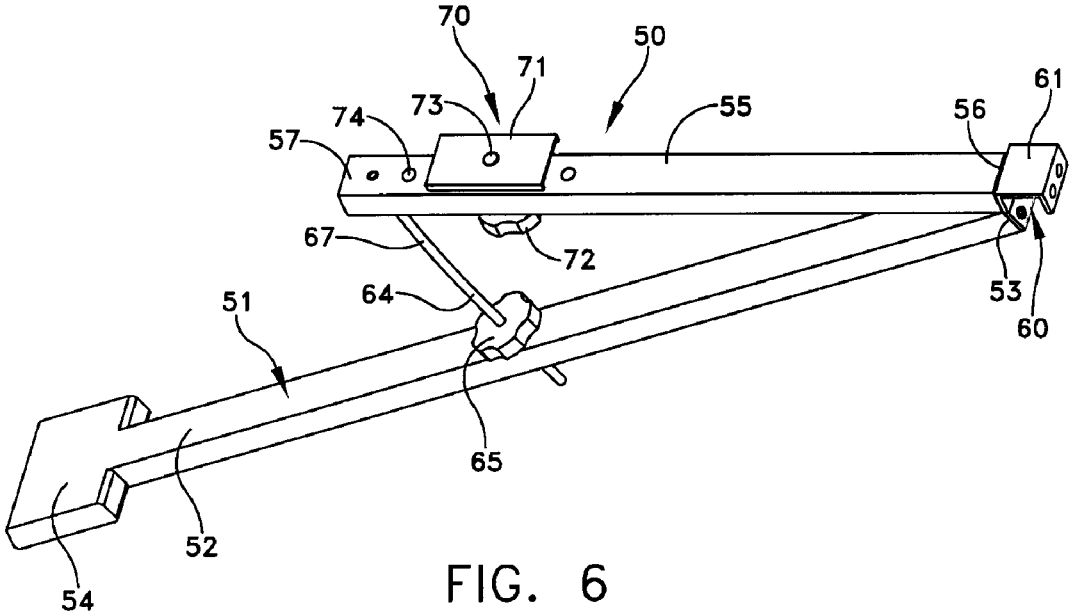
FIG. 6 is a perspective view of the crib bouncing device in FIG. 5.

FIGS. 5 and 6 depict still another alternative crib mattress bouncer 50 particularly adapted for foot actuation that allows a foot actuator to extend below a side railing, such as the side railing 23. In FIG. 5 like numerals are applied to the crib frame as are used in FIG. 1.

Referring to FIGS. 5 and 6 the bouncer 50 includes a treadle structure 51 with a first lever 52 having a first end 53 and a second end 54. A second lever 55 completes the bouncer 50 and includes a first end 56 and a second end 57. The first ends 53 and 56 of the levers 52 and 55 are positioned adjacent each other at a hinge 60.

Figure 7:
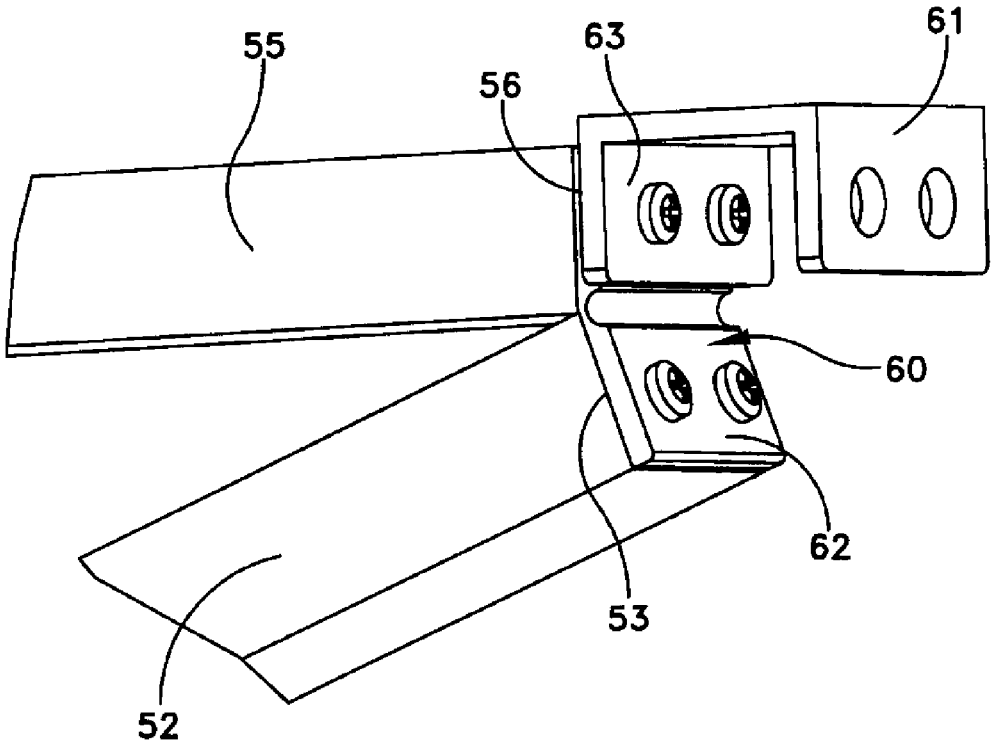
FIG. 7 is a detail of the crib bouncing device in FIGS. 5 and 6.

Now referring particularly to FIGS. 6 and 7, the hinge 60 has a first hinged leaf 62 attached to the first end 53 and a second hinged leaf 63 attached to the second end 56. Any number of hinged structures can be used, this particular hinge is shown as being formed from a plate with a coined hinge portion. This enables the variation of the angular relationship between the levers 52 and 55.

The angular relationship is established by angular adjustment structure, as by means of a threaded rod 64 and an adjustment wheel in the form of a thumb nut 65. The lever 52 includes means (not shown but known in the art) for capturing the thumb nut 65. When the thumb nut 65 is rotated, it advances or retracts the threaded rod 64 thereby to adjust the angle between the levers 52 and 55.

A clamp structure 70, like the clamp structure 35 formed by a clamping plate 71 with a thumb nut 72 that engages a machine screw 73 extending from the clamping plate 71. The machine screw 73 passes through the second lever 55 adjacent the second end 57. The lever 55 can include a plurality of attachment points 74 for aligning the clamping plate 71 with one of the tensioned wires 21 in FIG. 5.

During installation, the clamping plate 71 is disengaged from the thumb nut 72. The thumb nut 65 is adjusted to collapse the lever 55 onto the lever 52. Then the crib mattress bouncer 50 can be led underneath a side railing, such as the side railing 14 to position the inverted channel bracket 61 onto the side frame member 22. Then the clamping plate 71 can be reinserted to capture one of the tension wires between the clamping plate 71 and the second lever 55. The second lever 55 is set by positioning the machine screw 73 in an appropriate one of the attachment points 74 and tightening the thumb nut 72.

Rotating the thumb nut 65 can then angularly position the foot pad 54 to provide sufficient clearance above a floor or other supporting surface for producing the desired magnitude of deflection, in this case a downward deflection, of the center of the spring array 26 at the point at which the tension wire 21 is captured.

As will now be apparent, each of the embodiments of the crib mattress bouncing device, particularly those shown in FIGS. 2 and 6, provides a device that induces a pleasing, gentle motion in a crib mattress. Each device is easy to install. There are no permanent modifications of the crib. Each of the devices is easy to use and ergonomically friendly for use by hand or foot actuation. Each of the devices is portable and useful in a variety of crib frame designs and is inexpensive to manufacture.

This invention has been disclosed in terms of certain embodiments. It will be apparent that many modifications can be made to the disclosed apparatus without departing from the invention. For example, this invention has been disclosed in connection with a particular crib frame. Many variations of such a crib frame can benefit from this invention. Two specific embodiments of the crib mattress bouncing devices have been disclosed with specific levers, pivots, clamps and adjustment structures. A wide variety of components can be substituted for those specifically disclosed in the specification as will be apparent to those of ordinary skill in the art. Therefore, it is the intent of the appended claims to cover all such variations and modifications as come within the true spirit and scope of this invention.

What is claimed is:

1. A crib mattress bouncer for inducing a bouncing motion on a mattress support in a crib wherein the mattress support includes a peripheral frame and a flexible support spanning the peripheral frame, said crib mattress bouncer comprising:

A) a lever having first and second ends,

B) a pivot structure attached to said first end of said lever for engaging the peripheral frame to enable pivoting of said lever about the peripheral frame in a substantially vertical plane, and C) a clamp is located at an intermediate position of said lever to engage the flexible support, said lever, adjacent said second end thereof, forming an actuator whereby moving said actuator in one direction in the vertical plane causes said lever and said clamp to pivot about the frame to move a portion of the flexible support and whereby releasing said actuator causes the lever and clamp to pivot about the peripheral frame in the opposite direction whereby repeated use of said actuator causes the mattress to bounce.

2. A crib mattress bouncer as recited in claim 1 wherein said lever includes a plurality of attachment points for said clamp.

3. A crib mattress bouncer as recited in claim 1 wherein said pivot structure is detachable from the peripheral frame.

4. A crib mattress bouncer as recited in claim 1 wherein said clamp includes a clamping plate and tightening means for capturing a portion of the flexible support between said clamp and said lever.

5. A crib mattress bouncer as recited in claim 1 wherein said clamp attaches to said lever intermediate said ends thereof.

6. A crib mattress bouncer as recited in claim 1 wherein said second end of said lever forms a foot pedal and wherein crib mattress bouncer additionally comprises a second lever and an angular adjuster, said second lever having first and second ends and said pivot structure including a hinge with first and second hinge leaves, one of said hinge leaves being integral with said pivot structure, said hinge leaves attaching to said first ends of said first and second levers thereby to enable said first and second levers to pivot relative to each other, said angular adjuster being attached to said first and second levers thereby to fix the relative angular positions of said first and second levers, said clamp being attached to said second lever proximate said second end.

7. A crib mattress bouncer as recited in claim 6 wherein said second end of said first lever includes a foot pad for enabling the operation of said crib mattress bouncer by foot.

8. A crib mattress bouncer as recited in claim 7 wherein said angular adjuster includes a threaded rod and an adjustment nut for adjusting the relative angular positions of said first and second levers.

9. A crib mattress bouncer for inducing a bouncing motion on a mattress support in a crib wherein the mattress support includes a peripheral frame and an array of interconnected tensioned wires for supporting the mattress, said crib mattress bouncer comprising:

A) second degree lever means for releasably engaging the peripheral frame for forming a lever pivot at the peripheral frame for enabling said lever means to pivot in a substantially vertical plane, and B) clamping means attached to said lever means intermediate said ends thereof for engaging at least one of the tensioned wires, said lever means including actuator means formed at said other end of said lever means for enabling the displacement of said lever means in the vertical plane in a first direction to move the engaged and surrounding tensioned wires, releasing said actuator means causing said lever and clamping means to pivot about the frame in the opposite direction whereby repeated use of said actuator means causes the mattress to bounce.

10. A crib mattress bouncer as recited in claim 9 wherein said lever means includes a plurality of attachment points for said clamping means and said clamping means includes a clamping plate having a threaded rod extending therefrom and tightening means for causing said clamping plate to capture at least one tensioned wire against said lever means.

11. A crib mattress bouncer as recited in claim 8 wherein said clamping means attaches to said lever means intermediate said ends thereof and said actuator means forms a hand grip.

12. A crib mattress bouncer as recited in claim 8 wherein said lever means includes:

i) first and second levers having first and second ends, respectively, ii) hinge means attached to said first ends of said first and second levers thereby to enable each of said first and second levers to pivot relative to each other, iii) means for pivoting said first ends of said levers about the peripheral frame, and iv) angular adjustment means for fixing the relative positions of said first and second levers, said clamping means being attached to said second lever.

13. A crib mattress bouncer as recited in claim 12 wherein said actuator means forms a foot pad for enabling the operation of said crib mattress bouncer by foot.

14. A crib comprising:

A) a crib frame including a headboard, footboard and side railings,

B) a mattress support carried by said crib frame including a peripheral frame and a flexible support spanning said peripheral frame, C) a mattress on said mattress support, and D) a crib mattress bouncer for inducing motion of said mattress including:

i) a lever having first and second ends, ii) a pivot structure including an inverted channel attached to said first end of the lever for detachably engaging said peripheral frame whereby said lever can pivot in a substantially vertical plane, and iii) a clamp attached to said lever intermediate said ends thereof for engaging said flexible support at a central portion thereof, said second end of said lever forming an actuator whereby vertical motion imparted to said actuator in one direction causes said lever and said clamp to pivot about the peripheral frame to move said central portion of said flexible support and whereby releasing said actuator causes said lever and said clamp to pivot about said frame in the opposite direction whereby repeated use of said actuator causes said mattress to bounce.

15. A crib as recited in claim 14 wherein said lever includes a plurality of attachment points for said clamp intermediate the ends thereof thereby to adapt said crib mattress bouncer to differently configured cribs and said clamp includes a clamping plate having a threaded rod extending therefrom and an clamping nut for engaging said threaded rod whereby tightening said clamping nut causes said clamping plate to capture a portion of the flexible support against said lever.

16. A crib as recited in claim 14 wherein said crib mattress bouncer additionally comprises:

i) a second lever having a pivot end, ii) a hinge formed with inverted channel for attaching said first ends of said first and second levers thereby to enable said first and second levers to pivot relative to each other, and iii) an angular adjuster for fixing the relative angular position of said first and second levers, said clamp being attached to said second lever.

17. A crib as recited in claim 16 wherein the second end of said first lever includes a foot pad for enabling the operation of said crib mattress bouncer by foot.

18. A crib as recited in claim 17 wherein said angular adjuster includes a threaded portion and an adjustment nut for adjusting the relative positions of said first and second levers thereby to adapt the height of said foot pad for differently configured cribs.

19. A crib as recited in claim 14 wherein said lever includes a plurality of attachment points for said clamp thereby to accommodate differently configured cribs.

* * * * *